United States Patent [19]

Mederer

[11] 4,437,438

[45] Mar. 20, 1984

[54] RECIPROCATING PISTON ENGINE

[76] Inventor: Gerhard Mederer, Kellerstrasse 7, Allersberg/BDR, Fed. Rep. of Germany

[21] Appl. No.: 291,292

[22] Filed: Aug. 10, 1981

[30] Foreign Application Priority Data

Aug. 13, 1980 [DE] Fed. Rep. of Germany ..... 3030615

[51] Int. Cl.[3] ..... F02B 75/32

[52] U.S. Cl. ..... 123/48 B; 123/78 E; 123/197 AB

[58] Field of Search ..... 123/48 R, 48 B, 78 R, 123/78 E, 78 F, 197 R, 197 AB, 197 AC

[56] References Cited

U.S. PATENT DOCUMENTS 1,909,372 5/1933 McCollum et al. ..... 123/48 B 3,633,429 1/1972 Olson ..... 123/197 AB 3,693,463 9/1972 Garman ..... 123/197 AB 4,131,094 12/1978 Crise ..... 123/78 E

*Primary Examiner*—Craig R. Feinberg

*Attorney, Agent, or Firm*—McCormick, Paulding & Huber

[57] ABSTRACT

A reciprocating piston engine has at least one cylinder and a piston moveable back and forth therein. The piston is connected with a crank shaft through an articulated linkage which includes a first connecting rod pivotally connected to the piston, a second connecting rod pivotally connected to the crank shaft and a swinging lever, which swinging lever, at one of its ends, is pivotally supported for movement about a swing axis generally parallel to the crank shaft axis and which swinging lever, at its other end, is pivotally connected to both of the connecting rods.

11 Claims, 4 Drawing Figures

RECIPROCATING PISTON ENGINE

Figure 1:
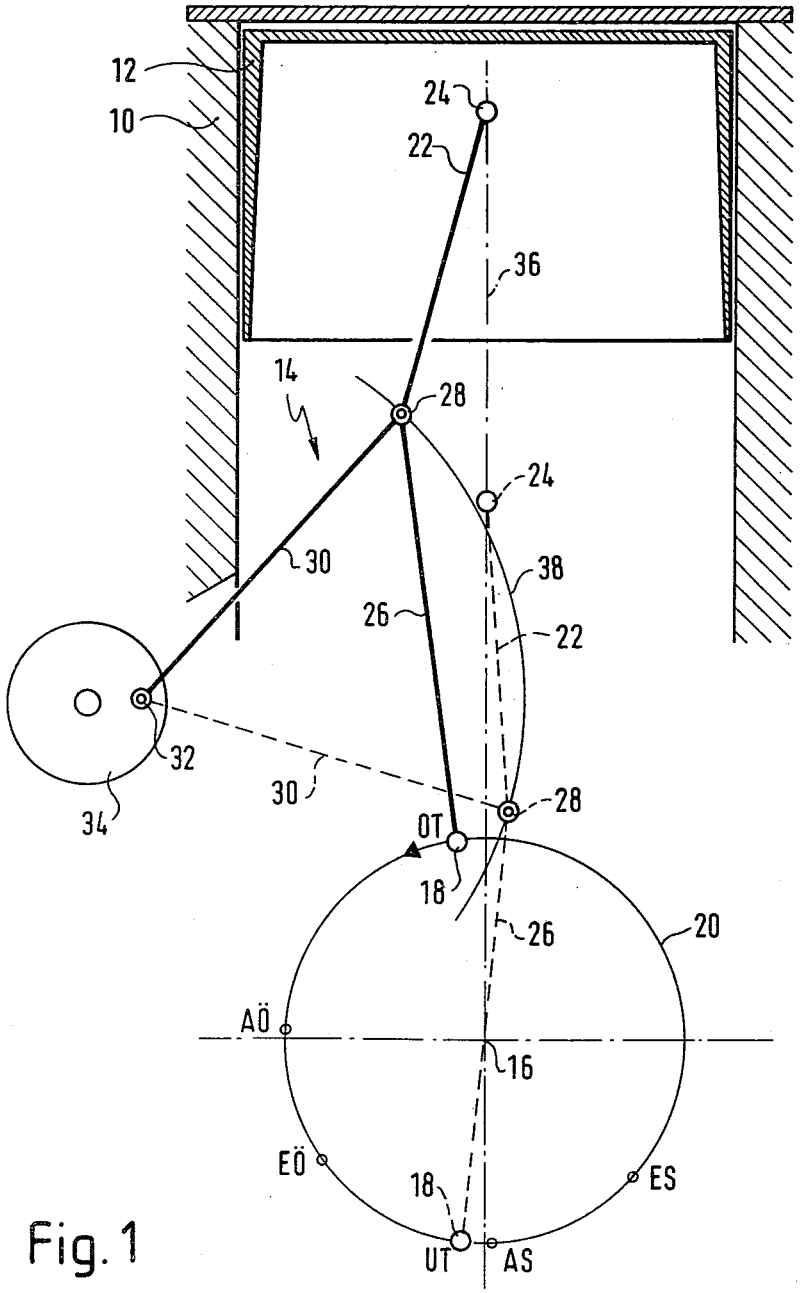

This invention concerns a reciprocating piston engine with at least one cylinder and a piston movable back and forth therein. The piston is connected with a crank shaft through an articulated linkage which includes a first connecting rod pivotally connected to the piston, a second connecting rod pivotally connected to the crank shaft and a swinging lever, which swinging lever, at one of its ends, is pivotally supported for movement about a swing axis generally parallel to the crank shaft axis and which swinging lever, at its other end, is pivotally connected to both of the connecting rods.

One such reciprocating piston engine is, for example, known from German O.S. No. 2,457,208. Therein the two connecting rods are pivotally connected to the swinging lever at two separated bearing points. With this construction, a generally longer dwell time of the piston at its top dead center position is achieved, then is the case with usual reciprocating piston engines wherein the piston is connected to the crank shaft through a single rigid connecting rod. Indeed, practice has shown that the possibilities to influence the turning moment characteristic curve and the piston speed with the construction according to German O.S. No. 2,457,208 are limited.

An object of the invention is to provide a reciprocating piston engine of the previously stated kind wherein the characteristic curve of the turning moment exerted by the piston on the crank shaft versus the crank shaft angle and the characteristic curve of the piston speed can be varied over a wide range so as to optimally suit the existing circumstances.

This object, in accordance with the invention, is achieved by having the two connecting rods connected to the swinging lever through a common joint. Through this only apparently simple measure, are obtained a surprising abundance of advantages and possibilities for changing the turning moment characteristic curve and the characteristic curve of the piston speed throughout a single revolution of the crank shaft.

In an especially preferred embodiment, the total length of the two connecting rods is larger than the displacement between the piston-sided rod bearing (pivot point of the first connecting rod relative to the piston) and the crank shaft-sided rod bearing, as measured with the piston in its top dead center position, with the pivot position and the length of the swinging lever being so chosen that in the case of movement of the piston away from its top dead center position, the movement paths of the common joint and of the piston-sided rod joint at least in a first portion of the movement approach one another, and in further travel, preferably intersect. This approach of the movement paths during swinging of the swinging lever has the effect not only, that the piston dwells relatively long in the vicinity of its top dead center position, but also has the result of that after a small movement of the piston in the direction toward the crank shaft, the bottom connecting rod already extends in such a position as to make it possible for it to exert a maximum turning moment onto the crank shaft. That means that the piston, in accordance with the solution made by the invention, experiences its maximum acceleration by the combustion pressure exactly when the maximum turning moment can be transferred, whereas in the case of usual engines, the piston has already traveled a relatively large distance rearwardly when the connecting rod reaches a position in which it can exert a maximum turning on the crank shaft. Therefore, it is possible in the case of an engine embodying the invention to convert a generally larger portion of the energy contained in the combustion gases into movement energy, then is the case with customary reciprocating piston engines.

The fact that the maximum turning moment transference is reached immediately after a small piston movement has an especially advantageous effect in the case of a two-cycle engine in which the outlet port is open at the latest after about 90 degrees of a crank shaft rotation. With the motor of the invention it is possible that by this point in time the greatest portion of the energy in the combustion gases has been converted into movement energy of the crank shaft, whereas in the case of a customary two-cycle engine the largest turning moment transference is first reached immediately before the opening of the outlet port, so that a considerable portion of the energy cannot profitably be used.

Because of the relatively long delay of the piston in its top dead center position, the burning of the fuel and the piston movement optimally adjust to one another. This is shown by the following example: With a customary engine with a rigid connecting rod, the beginning of the fuel injection lies about 16° (of a crank shaft revolution) before the top dead center and the end of the fuel injection about 2° to 0° before the top dead center. The combustion begins about 10° before the top dead center, so that the ignition lag amounts to about 6°. Because of this long ignition lag, there results not only a very violent combustion throughout the then already accumulated amount of unburned fuel, but the pressure of the combustion gases opposes the piston movement because the combustion begins before the piston reaches its top dead center position. If, in comparison with this, the same engine is built in accordance with the invention, and with otherwise equivalent proportions, the beginning of the injection can be shifted to 30° before the top dead center position and the end of the injection shifted to 10° after the top dead center position so that the combustion begins at the top dead center position. Such a shifting of the injection intervals in the direction toward a later time is possible because the piston delays longer in the vicinity of its upper top dead center position. The ignition lag is also only approximately half as long as in the case of the previously described comparable engine of the usual kind. Thereby such high injection temperatures and injection pressures do not appear as with usual engines. The energy of the combustion gas does not work against the piston movement, and instead can be immediately converted into a movement of the piston in the driving direction. The better energy utilization has the result of producing a lesser heating of the engine and a lower exhaust gas temperature. Further, the pollutant content of the exhaust, in the case of an engine embodying the invention, is generally smaller than it is in the case of a comparable engine. The pollutant content, in the case of a comparable engine, can indeed be lowered through a later fuel injection, but with this an accompanying strong fall-off in performance occurs.

Experiments have shown that with an engine according to the invention, in comparison to an otherwise similar conventional engine, a performance increase can be obtained, such as a fuel saving of at least 30% to 40% for the same work. A further advantage of the construction of the invention resides in that the most diverse fuels can be used, which do not, as previously, have to suit the combustion speed and/or the combustion point of the piston speed, but instead the piston speed can be changed and consequently can be made to optimally suit the fuel being used at the moment. For example, investigations have shown that a two-cycle diesel engine built in accordance with the invention without other changes can be operated with gasoline without marked decrease in performance. Such an operation with customary diesel motors is not possible without destroying the engine.

The tuning and adaptation of the engine to the desired proportions can be done in different ways. The position of the pivot point of the swinging lever for example plays a part and is preferably arranged radially outside of the cylinder. Axially the pivot point is preferably arranged between the point of the piston-sided connecting rod bearing which is closest to the crank shaft and the crank shaft axis.

The pivot point of the swinging lever can be fixed or can also be radially and/or axially adjustable, in order, for example, to suit the engine to changed drive conditions. For this purpose it is especially advantageous if the pivot point is adjustable during operation of the engine. With such an adjustment means the pivot point of the swinging lever can for example, suit the cylinder capacity to the momentary engine load in order to make possible a fuel saving in the case of light loads for the engine or in order to, on the other hand, make available a larger cylinder capacity if a corresponding performance is demanded.

Such an adjustment of the pivot point during engine operation can for example be achieved with the help of an eccentric on which the pivot point of the swinging lever is located.

Preferably the swinging lever and the two connecting rods are pivotally arranged symetrically to a plane containing the cylinder axis. For this purpose at least two of the three parts joined to one another in the common joint are of forked shape in the vicinity of the joint in such a way that one fork shaped part straddles the third part and fits between the fork legs of the second fork shaped part.

According to an essential feature of the invention the first fork shaped part is rigidly connected with a bearing bushing, whose exterior surface serves as a bearing surface for the third part received between its fork legs of the first fork shaped part, and through which a bearing bolt extends with the ends of which the fork legs of the second forked part are preferably rigidly connected. This above described joint is not only low in friction and small in size, but also make possible an optimal power transfer and has a very small axial expansion with any given material. This low axial expansion is necessary in order that the common joint can move through the counterweights of the crank shaft.

The crank shaft axis can be displaced relative to the cylinder axis in such a way that the movement path of the piston-sided connecting rod bearing lies outside of the plane which contains the crank shaft axis and which is oriented parallel to the cylinder axis. In that way the lateral piston pressure on the cylinder walls and the moment curve can be controlled.

Further possibilities for changing the moment curve and the piston speed to suit the given circumstances lie in the choice of the measurements of the connecting rods and of the swinging lever relative to the remaining measurements of the engine.

Further features and advantages of the invention are evident from the claims and the following description, which in connection with the accompanying drawings explain the invention by one embodiment.

Figure 2:
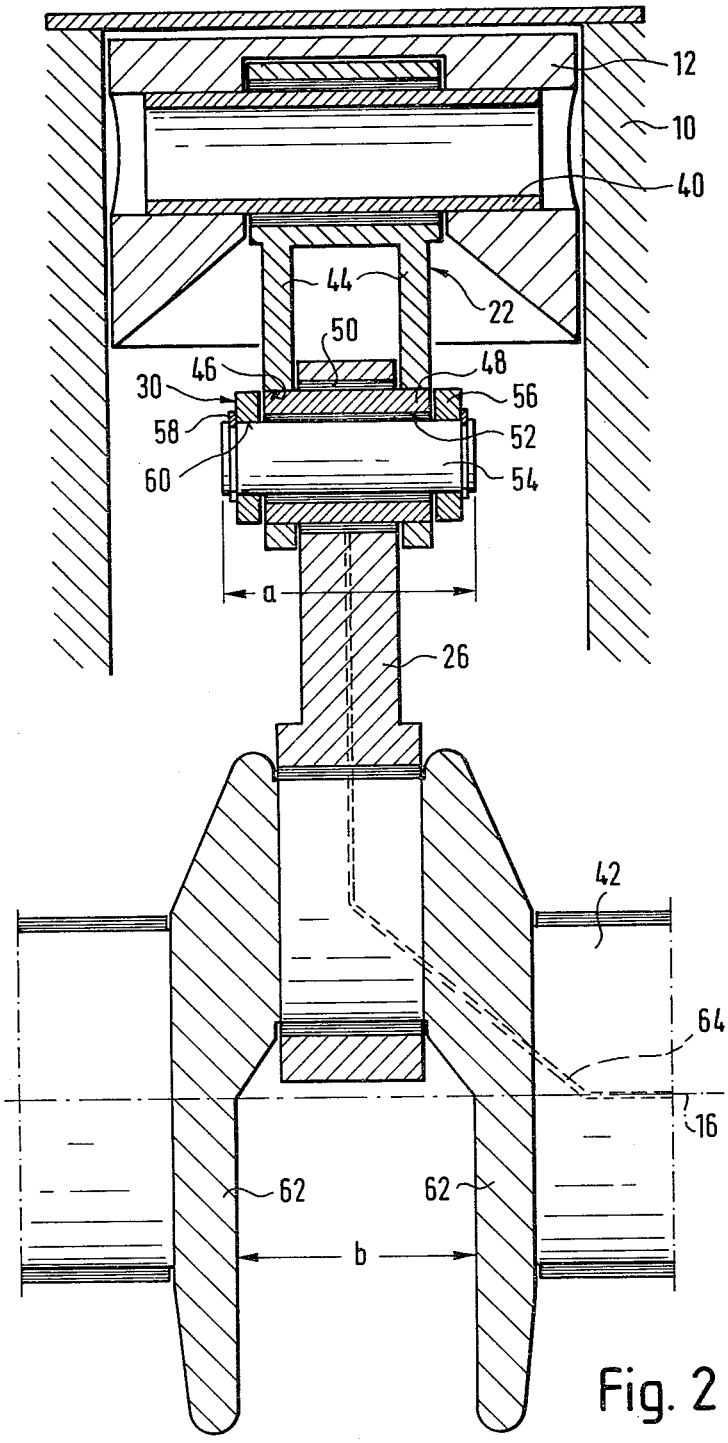
Figure 3:
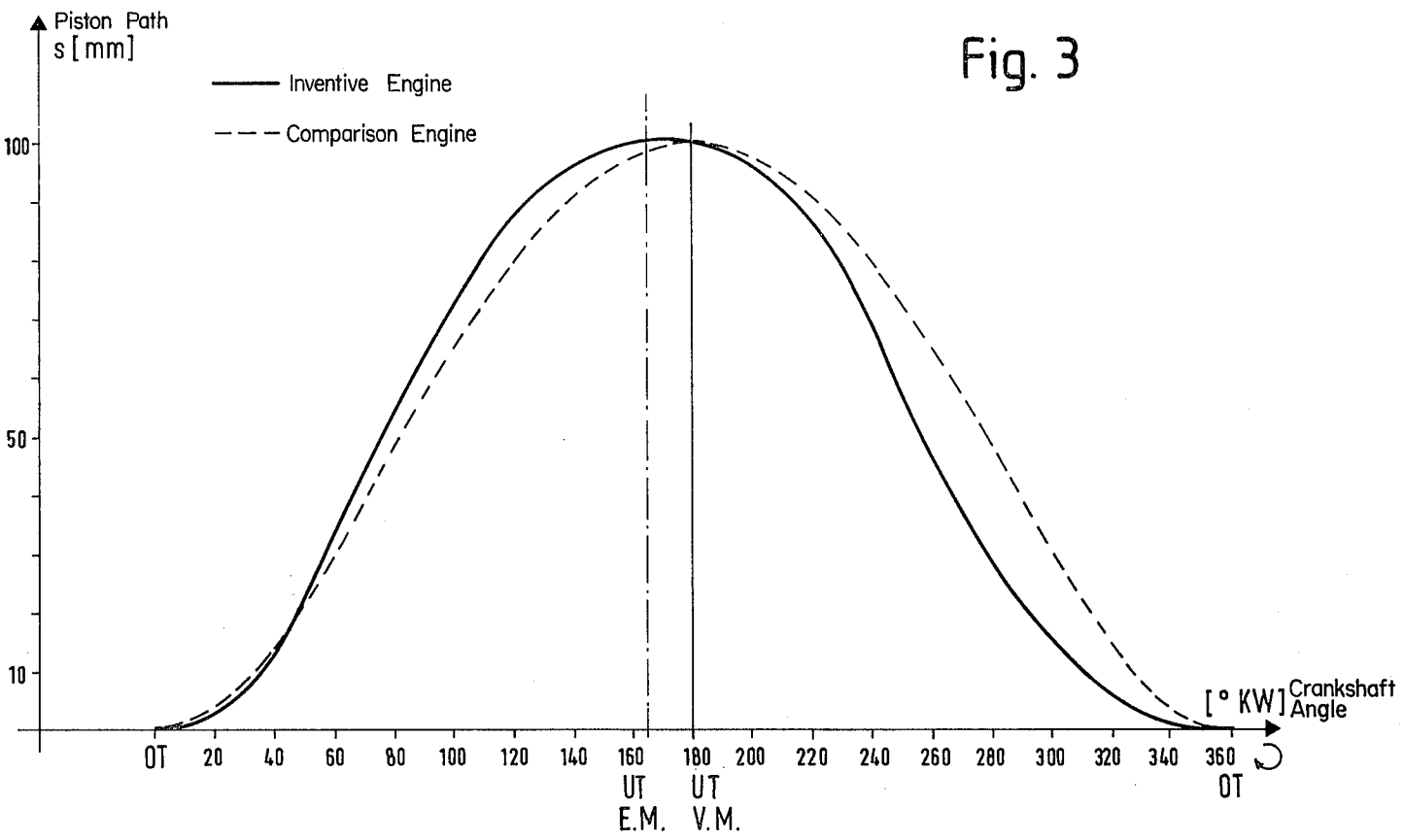
Figure 4:
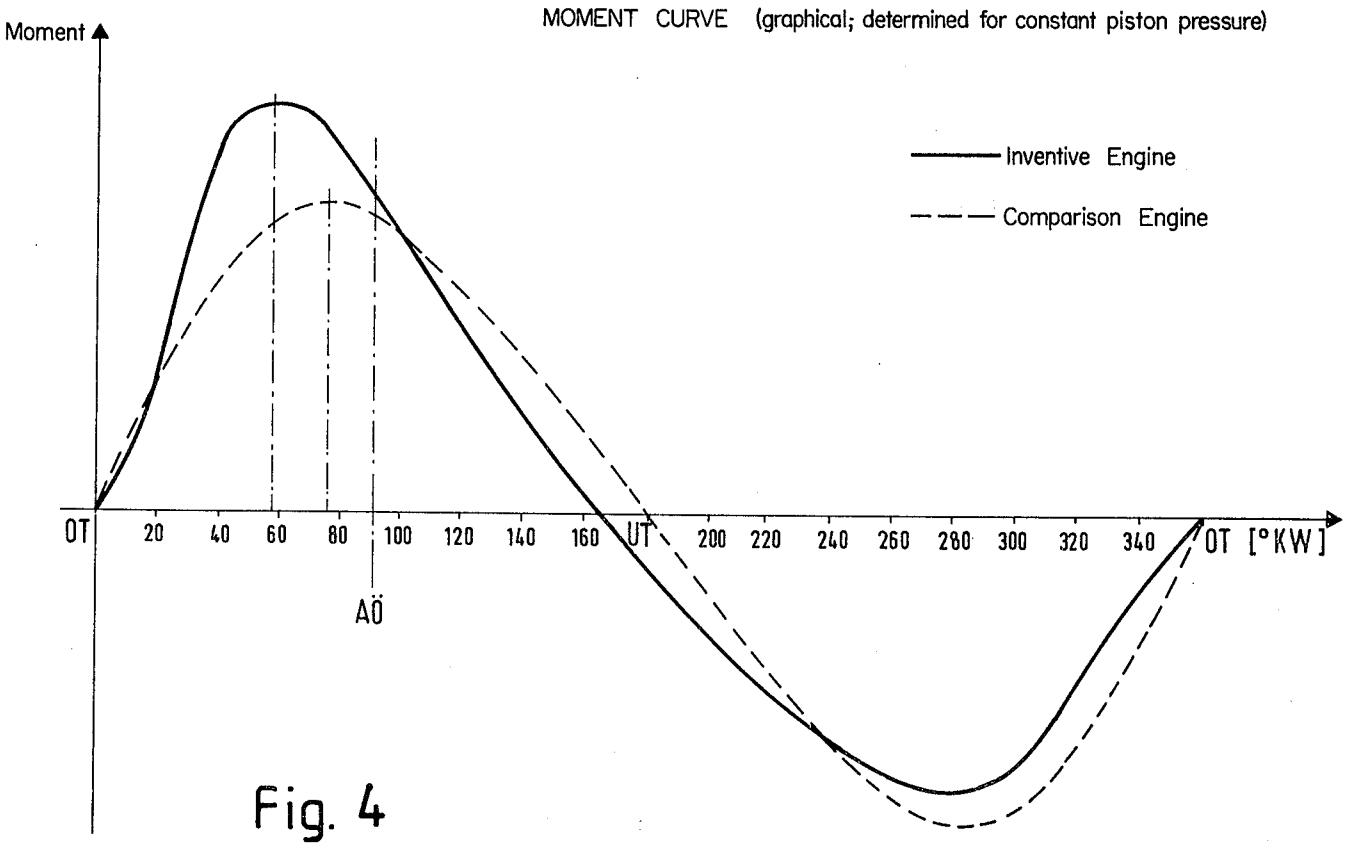

FIG. 1 is a schematic cross section taken on a plane containing the cylinder axis and vertical to the crank shaft axis through a cylinder of a reciprocating piston engine embodying the invention, FIG. 2 is a schematic cross section taken on a plane containing the crank shaft axis and passing through the connecting rod bearings and the common joint of FIG. 1, FIG. 3 is a graphical representation of the piston displacement on the case of a customary engine and in the case of an engine embodying the invention and, FIG. 4 is a graphical comparison of the moment characteristic in the case of a customary engine and in the case of an engine embodying the invention.

In FIG. 1 is seen a cylinder 10, represented only schematically, in which a piston 12 is movable up and down. The piston 12 is connected, by means of a linkage 14, also represented schematically, with the crank shaft, which in FIG. 1 is represented only through its axis 16 and through the crank shaft-sided connecting rod bearing 18 which travels through the circular path 20. The linkage 14 includes a first upper connecting rod 22, which is pivotally connected to the piston-sided connecting rod bearing 24. The connection in this case can be made in the usual way through a piston bolt. To the linkage 14 also belongs a second lower connecting rod 26, which is pivotally connected at its lower end by a crank shaft-sided connecting rod bearing 18. Both connecting rods 22 and 26 are connected in a common joint 28 with one end of a swinging lever 30 whose other end is pivotally connected by a bearing 32 to an eccentric 34, by the turning of which the position of the bearing 32 can be varied. However, the bearing 32 could also be fixed in place.

In FIG. 1 the piston is in its top dead center position. The corresponding position of the crank shaft-sided connecting rod bearing 18 is indicated by the reference letters OT. With a downward movement of the piston 12 the piston sided-connecting rod bearing 24 moves along the cylinder axis 36. The common joint 28 moves along the circular path 38 around the axis of the bearing 32. The crank shaft and with it the crank shaft-sided connecting rod bearing 18 move in the direction of the arrow. The position of the connecting rods 22 and 26, of the common joint 28 and of the swinging lever 30 in the bottom dead center position of the piston 12 are illustrated by the dashed lines. The corresponding position of the crank shaft-sided connecting rod bearing 18 is illustrated by the reference letter UT.

It is seen that the movement paths 38 and 36, with the downward movement of the piston 12 from its top dead center position, approach one another and in further travel of the downward movement of the piston intersect one another. This has the result that the piston moves only slowly out of its top dead center position while the crank shaft-sided connecting rod bearing 18 already moves through a relatively large crank shaft angle, and the lower connecting rod 26 reaches such position in which it is prepared to transfer a large turning moment. These interrelations can be qualitatively taken from the curves represented in FIGS. 3 and 4.

FIG. 4 shows with the solid lines the moment characteristic in the case of an engine embodying the invention, wherein the abscissa shows 360° of a crank shaft rotation and the ordinate shows the value of the turning moment for constant piston pressure. The broken lines give the curve for the moment in the case of a customary comparison engine. As can be seen, the maximum turning moment in the engine embodying the invention is reached at about 58° of crank shaft rotation and in the case of the comparison engine is reached at about 76° of crank shaft rotation. If one goes with these values to FIG. 3 which illustrate the piston displacement versus crank shaft rotation, and wherein the solid lines apply to the engine embodying the invention and the broken lines apply to the comparison engine, it can be seen that with 58° of crank shaft rotation the piston in the case of the inventive engine has hardly traveled ⅓ of its stroke, whereas in the case of the comparison motor at 76° of crank shaft rotation it has already traveled close to 50% of its stroke. Moreover it can be taken from FIG. 3 that the piston in the comparison engine leaves its top dead center position earlier and again reaches it later, so that all together it delays a much shorter time in the vicinity of its top dead center position then does the piston of the engine embodying the invention.

The previously named values are to be understood to be generally only examples and serve for a two-cycle diesel motor with valve control and fuel injection. The points in time at which the outlet valve and inlet valves open and close are in FIG. 1 shown on the circle 20 by the reference letters AO, EO, AS, and ES, with AO being the opening point of the outlet valve, EO being the opening time of the inlet valve, AS the closing time of the outlet valve and ES the closing time of the inlet valve. By comparison of FIG. 4 and FIG. 1 it can be seen that the maximum turning moment in the case of the engine embodying the invention is reached long before the opening of the exhaust is reached so that the energy of the burning gas can be efficiently converted to movement energy of the crank shaft. In the case of the comparison engine the maximum turning moment is reached first shortly before the opening of the exhaust, so that a considerable part of the energy is wasted. Together with a lower heating of the engine and of the exhaust on account of the better conversion of the combustion energy into movement the previously described favorable condition of the turning moment makes the inventive construction especially important and advantageous for the construction and drive of two-cycle engines.

In FIG. 1 the linkage is so represented that the upper connecting rod 22 is shorter than the lower connecting rod 26. Alternatively, if the upper connecting rod for example is longer than the lower connecting rod the piston side force will be smaller. The then shorter lower connecting rod goes faster past the position in which it is tangential to the circle 20 and in which the maximum turning moment is provided.

The construction of the invention can also be used with a four-cycle engine with advantage. In this case by a corresponding choice of the connecting rod lengths and of the position of the pivot points it can be achieved that during the intake cycle the effective braking moment on the crank shaft is held as small as possible.

In FIG. 2 the connecting rods of the linkage and their bearings are particularly represented. Similar parts are again represented with the same reference characters. The upper connecting rod 22 is journaled in the customary way by means of a piston bolt 40 in the piston 12. The lower connecting rod 26 is also journaled in a known way by the lower connecting rod bearing 18 to the crank shaft 42. The upper connecting rod 22 is fork shaped so as to have fork legs 44. The fork legs 44 have openings 46 in which a bearing bushing 48 is pressed with a press fit.

The bearing bushing 48 is for example made of steel and on the portion thereof located between the fork legs 44 the lower connecting rod 26 is rotatably supported by means of a bearing 50. In the bearing bushing 48 a bearing bolt 54 is rotatably supported by means of a bearing 52 and on the ends of the bearing bolt which extend beyond the bearing bushing 48 the fork legs 56 of the fork shaped swinging lever 30 are received. The fork legs 56 can be rotatably supported on the bearing bolt 54 and secured by means of snap rings 58. Preferably, they are however rigidly connected with the bearing bolt 54 by means of a press fit of the bearing bolt 54 in the bore 60 of the swinging lever 56. By means of this construction not only is the bearing rubbing in the joint and its wear avoided, but also a short axial construction of the joint is achieved so that the joint can move between the counterweights 62 on the crank shaft 42. That means that the axial dimension of the joint is smaller than the distance b between the sides of the counterweights 62.

Lubrication of the joint 28 occurs through a lubrication channel 64 by means of lubricating oil which is taken on from the crank case of the engine.

In conclusion, it can be said that with the engine embodying this invention a 35% to 50% lower fuel requirement can be achieved or a corresponding higher performance can be achieved then with a similar comparison engine. The heating of the engine and of the exhaust is at least 25% lower. Therefore, the exhaust also contains less pollutants. It results in lower peak pressures and because of the short ignition delay there is obtained a smooth combustion, that is a combustion approximating that of a constant volume. The running of the engine is essentially quieter than in the case of a customary engine. The engine can be driven with diesel oil, gasoline or also less valuable fuels. The invention is also useable with advantage with four cycle engines, especially if these are provided with pistons of light metal.

I claim:

1. A reciprocating piston engine comprising at least one cylinder and a piston movable back and forth therein along a cylinder axis, which piston is connected to a crank shaft, rotatable about a crank shaft axis, through a linkage including a first connecting rod pivotally connected to said piston by a piston-sided connecting rod bearing, and a second connecting rod pivotally connected to said crank shaft by a crank shaft-sided connecting rod bearing wherein said second connecting rod is longer in length than said first connecting rod, and a swinging lever pivotally support at one end for movement about a pivot axis essentially parallel to said crank shaft axis and at its other end hingedly connected to both of said connecting rods through a common joint, said two connecting rods having a total length being larger than a distance between said piston-sided connecting rod bearing and a path of said crank shaft-sided connecting rod bearing when said piston is in its top dead center position, and said pivot axis having a location and said swinging lever having a length being so chosen that at the top dead center position of said piston said common joint is displaced a substantial distance from said cylinder axis and is located on a side of said cylinder axis same as said pivot axis of said swinging lever and so that during initial portion of movement of said piston away from its top dead center position said common joint approaches said cylinder axis and so that during a subsequent portion of the movement of said piston away from its top dead center position said common joint crosses said cylinder axis so as to then be located on the opposite side of said cylinder axis from said pivot axis of said swinging lever.

2. A reciprocating piston engine according to claim 1 further characterized in that a movement path of the piston-sided connecting rod bearing is located outside of a plane containing the crank shaft axis and oriented parallel to the cylinder axis.

3. A reciprocating piston engine according to claim 1 further characterized in that a radius of a circle described by the crank shaft-sided connecting rod bearing is of about 1/5 a distance between the crank shaft axis and the piston-sided connecting rod bearing in the top dead center position of the piston, that the length of the second connecting rod is about 1.4 times the length of the first connecting rod, that the total length of the connecting rods are about 2.5 percent larger than a distance between the piston-sided connecting rod bearing and the circle described by the crank shaft-sided connecting rod bearing in the top dead center position of the piston 12, that the length of the swinging lever is about 1.3 times the length of the first connecting rod, that a radial displacement of the pivot point of the swinging lever from the cylinder axis is about 1.2 times the length of the first connecting rod and that an axial displacement of a pivot point on said pivot axis of the swinging lever from the crank shaft axis is a distance of about ⅓ than of the piston-sided connecting rod bearing from the crank shaft axis in the top dead center position of the piston.

4. A reciprocating piston engine according to claim 1 further characterized in that two out of a group of three parts comprising said two connecting rods and said swinging lever which are connected together in said common joint are fork shaped at least in a vicinity of said joint so that each of said two fork shaped parts has two spaced fork legs, one of said fork shaped parts straddling the remaining third part and being received between the two fork legs of the second fork shaped part, said first fork shaped part being rigidly connected with a bearing bushing whose outside surface which lies between said fork legs of said first fork shaped part serves as a bearing surface for the third part which lies between said fork legs of said first fork shaped part and through which bushing a bearing bolt runs having ends to which said fork legs of said second fork shaped part are connected.

5. A reciprocating piston engine according to claim 4 further characterized in that the fork legs of the second fork shaped part are rigidly connected with the ends of the bearing bolt.

6. A reciprocating piston engine according to any one of claims 4 or 5 further characterized in that the first fork shaped part constitutes said first connecting rod and said second fork shape part constitutes said swinging lever.

7. A reciprocating piston engine according to claim 1 further characterized by said cylinder and said crankshaft being so arranged that said cylinder axis intersects said crankshaft axis.

8. A reciprocating piston engine according to claims 1 or 7 further characterized in that said pivot axis of the swinging lever is fixed.

9. A reciprocating piston engine according to any one of claims 1 or 7 further characterized in that said pivot axis of the swinging lever is at least one of radially and axially adjustable.

10. A reciprocating piston engine according to claim 9 further characterized in that said pivot axis of the swinging lever is adjustable during engine operation.

11. A reciprocating piston engine accordingly to claim 9 further characterized in that said pivot axis of the swinging lever is arranged on a rotatably supported eccentric.

* * * * *